US009404631B2

(12) United States Patent
Tsutsumi et al.

(10) Patent No.: US 9,404,631 B2
(45) Date of Patent: Aug. 2, 2016

(54) LIGHT EMITTING APPARATUS AND AUTOMOTIVE LAMP

(71) Applicant: KOITO MANUFACTURING CO., LTD., Minato-ku (JP)

(72) Inventors: Yasuaki Tsutsumi, Shizuoka (JP); Naoki Sone, Shizuoka (JP)

(73) Assignee: KOITO MANUFACTURING CO., LTD., Minato-Ku, Tokyo (JP)

( * ) Notice: Subject to any disclaimer, the term of this patent is extended or adjusted under 35 U.S.C. 154(b) by 36 days.

(21) Appl. No.: 14/483,683

(22) Filed: Sep. 11, 2014

(65) Prior Publication Data

US 2014/0376244 A1 Dec. 25, 2014

Related U.S. Application Data

(63) Continuation of application No. PCT/JP2013/001296, filed on Mar. 4, 2013.

(30) Foreign Application Priority Data

Mar. 15, 2012 (JP) ..... 2012-058188

(51) Int. Cl.
*F21S 8/10* (2006.01)
*F21V 13/08* (2006.01)

(52) U.S. Cl.
CPC ..... *F21S 48/1394* (2013.01); *F21S 48/1154* (2013.01); *F21S 48/1225* (2013.01); *F21S48/1317* (2013.01); *F21S 48/1329* (2013.01); *F21V 13/08* (2013.01); *F21S 48/115* (2013.01); *F21S 48/325* (2013.01)

(58) Field of Classification Search
CPC ..... F21S 48/1394; F21S 48/1154; F21S 48/1225; F21S 48/1317; F21S 48/1329; F21V 13/08
See application file for complete search history.

(56) References Cited

U.S. PATENT DOCUMENTS 7,789,531 B2 * 9/2010 Duong ..... H01L 33/20 362/257
2007/0152230 A1 7/2007 Duong et al.
(Continued)

FOREIGN PATENT DOCUMENTS

CN 1604350 A 4/2005
CN 101996987 A 3/2011
(Continued)

OTHER PUBLICATIONS

International Search Report (Form PCT/ISA/210) issued on May 14, 2013, by the Japanese Patent Office as the International Searching Authority in the corresponding International Application No. PCT/JP2013/001296. (4 pages).
(Continued)

*Primary Examiner* — Mary Ellen Bowman
(74) *Attorney, Agent, or Firm* — Buchanan Ingersoll & Rooney PC

(57) ABSTRACT

A light emitting apparatus includes LED chips and a light condenser condensing the light emitted from the LED chips. The light condenser has a first opening functioning as an incident part through which the light emitted from the LED chips enters, a side surface function as a reflector that reflects the light having entered through the first opening, and a second opening functioning as an emission part that emits the light reflected by the side surface. A phosphor layer, which converts the wavelength of the light emitted from the LED chips and emits the wavelength-converted light, is formed in the first opening. The light condenser is arranged such that the phosphor layer is located on the light emission surfaces of the LED chips.

2 Claims, 7 Drawing Sheets

(56) References Cited

U.S. PATENT DOCUMENTS

| | | | | |
|---|---|---|---|---|
| 2008/0080207 | A1* | 4/2008 | Specht | F21S 48/1241 362/581 |
| 2009/0046474 | A1* | 2/2009 | Sato | B60Q 1/076 362/466 |
| 2011/0032702 | A1* | 2/2011 | Mizuno | H01L 25/0753 362/247 |
| 2011/0292636 | A1 | 12/2011 | Fukai et al. | |
| 2012/0008098 | A1* | 1/2012 | Akiyama | G02B 19/0057 353/30 |
| 2014/0376246 | A1* | 12/2014 | Yatsuda | B60Q 1/04 362/511 |

FOREIGN PATENT DOCUMENTS

| | | | |
|---|---|---|---|
| CN | 102192459 | A | 9/2011 |
| EP | 1 418 628 | A1 | 5/2004 |
| EP | 2 282 340 | A2 | 2/2011 |
| JP | 2001-202812 | A | 7/2001 |
| JP | 2004-349646 | A | 12/2004 |
| JP | 2008-231218 | A | 10/2008 |
| JP | 2011-040495 | A | 2/2011 |

OTHER PUBLICATIONS

International Preliminary Report on Patentability (Form PCT/IB/373) and the Written Opinion of the International Searching Authority (Form PCT/ISA/237) issued on Sep. 16, 2014, in the corresponding International Application No. PCT/JP2013/001296. (11 pages).

The extended European Search Report issued on Oct. 13, 2015, by the European Patent Office in corresponding European Patent Application No. 13761876.5-1756. (7 pages).

First Office Action issued on Nov. 3, 2015 by the Chinese Patent Office in corresponding Chinese Patent Application No. 201380014264.6 and English translation (14 pages).

* cited by examiner

LIGHT EMITTING APPARATUS AND AUTOMOTIVE LAMP

BACKGROUND OF THE INVENTION

1. Field of the Invention

The present invention relates to a light emitting apparatus using light emitting devices, such as LEDs (light-emitting diodes), and an automotive lamp.

2. Description of the Related Art

In the conventional practice there are known automotive lamps using LEDs as the light source (See Patent Document 1 in the following Related Art Documents, for instance).

RELATED ART DOCUMENTS

Patent Documents

[Patent Document 1] Japanese Patent Application Publication No. 2011-40495.

For automotive lamps using the LEDs, it is desirable that the light emitted from the LEDs be effectively utilized.

SUMMARY OF THE INVENTION

The present invention has been made in view of the foregoing circumstances, and a purpose thereof is to provide a light emitting apparatus and an automotive lamp capable of improving the utilization efficiency of light emitted from LEDs.

In order to resolve the above-described problems, a light emitting apparatus according to one embodiment of the present invention includes: a mounting part that mounts a light emitting device thereon; and a light condenser that condenses light emitted from the light emitting device, the light condenser including (1) an incident part through which the light emitted from the light emitting device enters, (2) a reflector that reflects light entering from the incident part, and (3) an emission part that emits light reflected by the reflector. In this light emitting apparatus, a phosphor layer, which converts a wavelength of the light emitted from the light emitting device and emits the wavelength-converted light, is formed in the incident part, and the light condenser is arranged such that the phosphor layer is located on a light emission surface of the light emitting device.

The light condenser may be of a frame shape having a first opening, a second opening disposed counter to the first opening, and a side surface part disposed in between the first opening and the second opening, and the first opening may functions as the incident part, the second opening may function as the emission part, and the reflector may be formed such that a metallic film is formed on an inner surface of the side surface part. The phosphor layer may be formed by filling the first opening with a resin containing a fluorescent material.

The mounting part may be arranged such that a plurality of light emitting devices are able to be mounted side by side, and the light condenser may further include a light shielding part provided in such a manner as to demarcate the adjacent light emitting devices.

The light condenser may include a molded body made of transparent material having a first surface part, a second surface part disposed counter to the first surface part, and a side surface part disposed in between the first surface part and the second surface part. In this light condenser, the first surface part may function as the incident part, the second surface part may function as the emission part, and the reflector may be formed such that a metallic film is formed on an outer surface of the side surface part. The phosphor layer may be formed by embedding a part of plate-shaped phosphor in the first surface part.

The mounting part may be arranged such that a plurality of light emitting devices are able to be mounted side by side, the molded body made of transparent material may be arranged for each of the plurality of light emitting devices and, in each molded body made of transparent material, a metallic film is formed on an adjacent surface facing an adjacent molded body made of transparent material as well as the outer surface of the side surface part.

Another embodiment of the present invention relates to an automotive lamp. The automotive lamp includes: the above-described light emitting apparatus; and an optical member that controls the light emitted from the light emitting apparatus so as to emit the light therefrom toward a front area of the automotive lamp.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

Hereinafter, a detailed description is given of embodiments of the present invention with reference to drawings.

Figure 1:
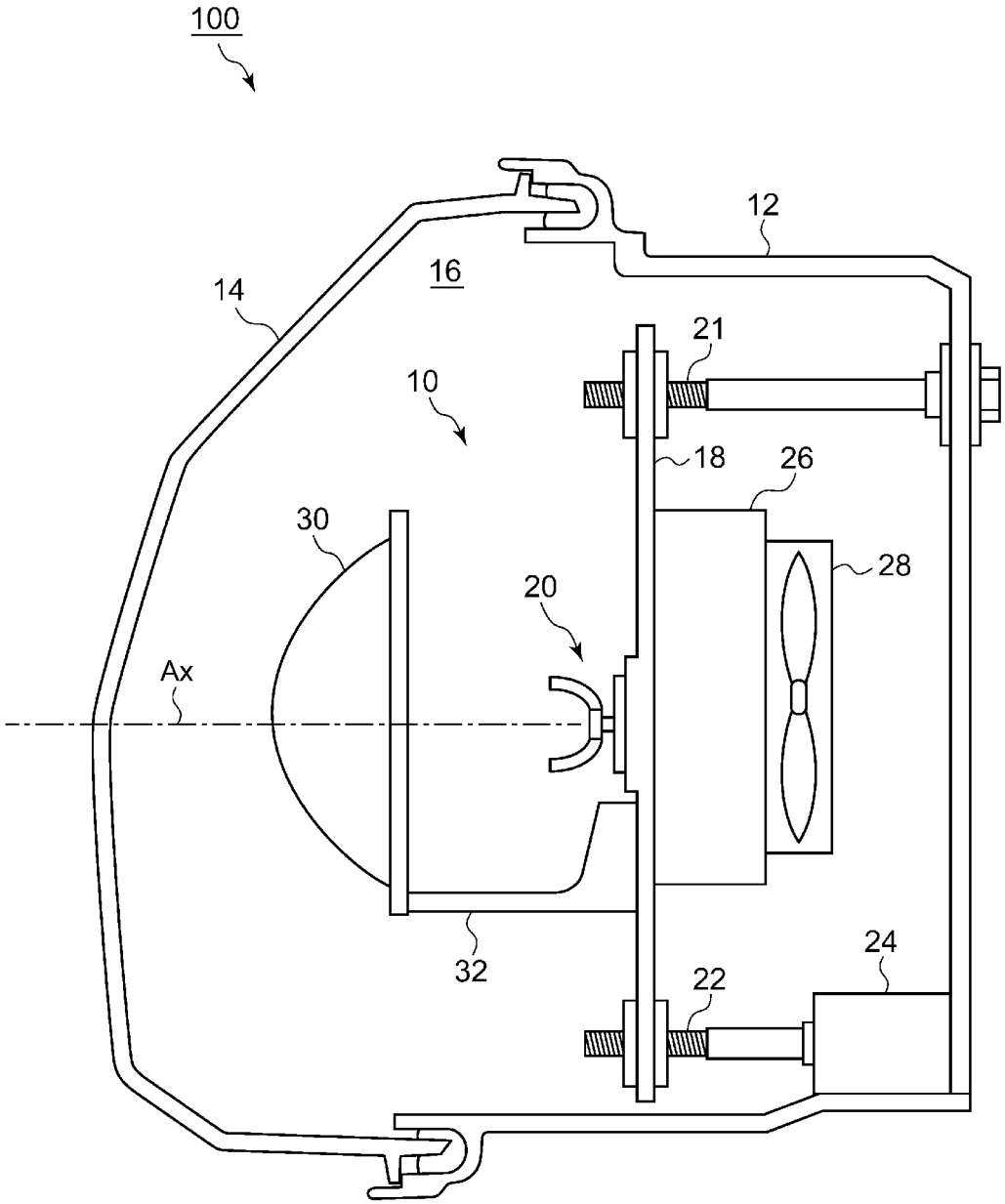
FIG. 1 is a cross-sectional view of an automotive lamp according to an embodiment of the present invention.

FIG. 1 is a cross-sectional view of an automotive lamp 100 according to an embodiment of the present invention. The automotive lamp 100 is a so-called projector-type automotive headlamp having a projection lens.

As shown in FIG. 1, the automotive lamp 100 includes a lamp body 12 having a recess that is open toward a front part of the lamp, and a cover 14 for blocking the opening surface of the lamp body 12. And an internal space formed by the lamp body 12 and the cover 14 is formed as a lamp chamber 16.

A lamp unit 10 is placed within the lamp chamber 16. As shown in FIG. 1, the lamp unit 10 is mounted in an approximately central part of a bracket 18. Here, the bracket 18 is formed of a metal such as aluminum. A first aiming screw 21 is mounted on an upper portion of the bracket 18, whereas a second aiming screw 22 is mounted on a lower portion of the bracket 18. The bracket 18 is directly supported by the first aiming screw 21, the second aiming screw 22 and a support portion (not shown) holding a pivot attached to the bracket 18. Also, the bracket 18 is indirectly supported by the lamp body 12 in a freely tiltable manner. The lower second aiming screw 22 is provided with an aiming actuator 24. As the aiming actuator 24 is driven, the bracket 18 is tilted, which thereby causes the lamp unit 10 to be tilted. As a result, the light axis of the illuminating light is variably controlled.

The lamp unit 10 includes a light emitting apparatus 20, a projection lens 30, a lens support member 32, a heatsink 26, and a fan 28.

The light emitting apparatus 20 is provided at a front side of the bracket 18. The light emitting apparatus 20, which includes a white-light LED, emits white light toward the projection lens 30. A detailed structure of the light emitting apparatus 20 will be discussed later.

The projection lens 30 is an optical member that projects the light emitted from the light emitting apparatus 20 toward a front area of the automotive lamp 100. The projection lens 30 is a plano-convex aspheric lens wherein the incident surface of the projection lens 30 is formed with a plane surface and the emission surface thereof is formed with a convex surface. The projection lens 30 is supported, by the lens support member 32, in front of the light emitting apparatus 20. A light axis Ax of the projection lens 30 is approximately parallel to the front-back direction of a vehicle.

The heatsink 26 is provided on a back side of the bracket 18. The heatsink 26, which is formed of aluminum or other metal having a high thermal conductivity, radiates the heat generated by the light emitting apparatus 20. The fan 28, which is disposed at the back of the heatsink 26, is used to effect a forced air cooling of the heatsink 26.

Figure 2A:
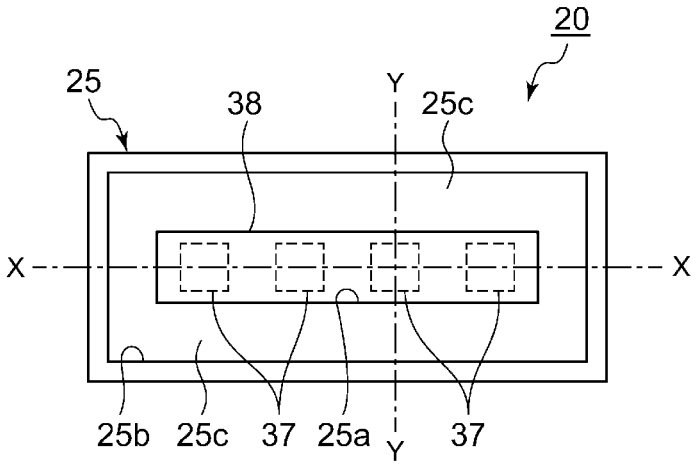
FIG. 2A to FIG. 2C are diagrams for explaining a structure of a light emitting apparatus according to a first embodiment.
Figure 2B:
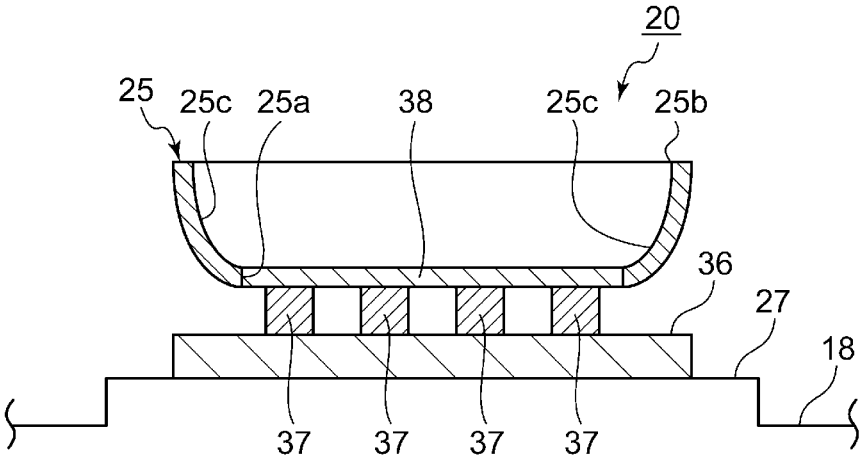
Figure 2C:
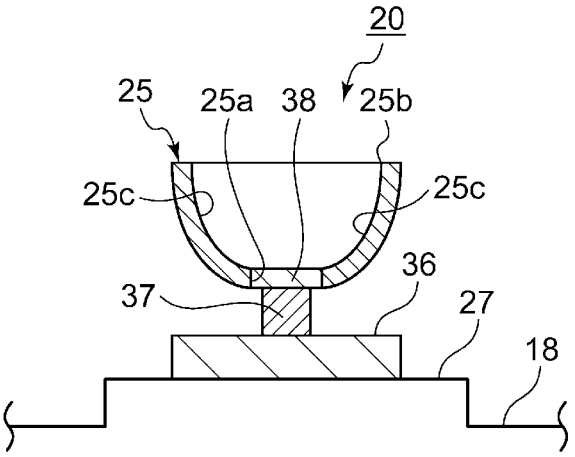

FIG. 2A to FIG. 2C are diagrams for explaining a structure of a light emitting apparatus according to a first embodiment. FIG. 2A is a front view of the light emitting apparatus. FIG. 2B is a cross-sectional view (horizontal cross-sectional view) taken along the line X-X of FIG. 2A. FIG. 2C is a cross-sectional view (vertical cross-sectional view) taken along the line Y-Y of FIG. 2A.

As shown in FIG. 2B and FIG. 2C, the light emitting apparatus 20 is mounted in an approximately central part of a base 27, which is formed integrally with the bracket 18 by an aluminum die casting. The light emitting apparatus 20 includes an LED substrate 36 provided on top of the base 27, four LED chips 37 mounted on top of the LED substrate 36, and a light condenser 25 placed on these LED chips 37.

The LED chips 37 are a blue-color LED of a square with the side length of 1 mm, a blue-color LED of a square with the side length of 0.3 mm, a blue-color LED of a square with the side length of 0.5 mm, and so forth, for instance. The four LED chips 37 are arranged horizontally in a series on the LED substrate 36. The LED substrate 36, formed of aluminum nitride or the like, is so formed as to be able to mount the four LED chips 37 thereon. The LED substrate 36, which is provided with a power feeding pattern, a power feeding connector and so forth, has a function of supplying the current to the LED chips 37. For example, a so-called "split light distribution pattern" can be illuminated if the LED chips 37 on the both ends are turned on and the remaining two inner LED chips 37 are turned off. The split light distribution pattern is a light distribution pattern where a split region, in which no light is illuminated, is provided in part of a high-beam light distribution pattern. The split light distribution pattern is a light distribution pattern that can suppress the irradiation of light to a driver's own lane and an oncoming traffic lane and at the same time can ensure an excellent field of view outside the driver's own lane and the oncoming traffic lane.

The light condenser 25 has a function of condensing the light emitted from the LED chips 37 and a phosphor layer 38 and having the condensed light directed toward the projection lens 30. Provision of such a small-sized light condenser 25 nearest the LED chips 37 as in the present embodiment allows the traveling direction of light emitted from both the LED chips 37 and the phosphor layer 38 to be preferably controlled and thereby enables the light emitted therefrom to efficiently enter the projection lens 30.

The light condenser 25 is of a frame shape having an opening through which the light emitted from the LED chips 37 is passed, and the light condenser 25 has this opening in an approximately central part thereof. The light condenser 25 has a first opening 25*a*, a second opening 25*b* disposed counter to the first opening 25*a*, and a side surface part 25*c* disposed between the first opening 25*a* and the second opening 25*b*.

The first opening 25*a* and the second opening 25*b* are each a rectangular opening. The second opening 25*b* is larger in size than the first opening 25*a*. In the light condenser 25, the first opening 25*a* functions as an incident part through which the light emitted from the LED chips 37 enters, and the second opening 25*b* functions as an emission part that emits the light.

The side surface part 25*c* has four inner surfaces provided for each side of the first opening 25*a* and the second opening 25*b* of rectangle shapes. Here, the four inner surfaces are parabolic in cross section. A metallic film is formed on each of the inner surfaces of the side surface part 25*c*, and the side surface part 25*c* functions as a reflector that reflects the light entering through the first opening 25*a*.

The light condenser 25 may be formed in a manner such that a frame body is shaved out of aluminum materials of a rectangular parallelepiped shape and then the inner surface of the frame body is subjected to aluminum evaporation.

In the present embodiment, a resin a fluorescent material containing a fluorescent material is filled into the first opening 25*a* of the light condenser 25 and thereby the phosphor layer 38 are formed. The phosphor layer 38 has a function of wavelength-converting blue light emitted from the LED chips 37 into yellow light so as to be emitted. The light condenser 25 where the phosphor layer 38 is formed is arranged such that the phosphor layer 38 is located on light emission surfaces of the four LED chips 37. A light incident surface of the phosphor layer 38 is in contact with the light emission surfaces of the LED chips 37. Also, the phosphor layer 38 is optically coupled via a not-shown transparent material.

Illuminating the LED chips 37 in the light emitting apparatus 20 configured as above allows the blue light, which has transmitted through the phosphor layer 38, and the yellow light, whose wavelength has been converted by the phosphor layer 38, to be mixed together. As a result, white light is obtained.

As described above, in the light emitting apparatus 20 according to the present embodiment, the phosphor layer 38 filled with phosphors is formed in the first opening 25*a* that is the incident part of the light condenser 25. And the light condenser 25 is arranged such that the phosphor layer 38 covers the light emission surfaces of the four LED chips 37. With this structure, no gaps exists in between the side surface of the phosphor layer 38 and the light condenser 25. Thus, this structure allows most of light emitted from the LED chips 37 to enter the light condenser 25. As a result, the projection lens 30 can direct more light and therefore the utilization efficiency of light emitted therefrom can be improved in the automotive lamp 100. If the inner surface of the side surface part 25*c* of the light condenser 25 has the shape of a compound parabolic concentrator (CPC), the light emitted through the first opening 25*a* can be emitted in a fixed direction. In this case, therefore, much light can be directed onto the projection lens 30 more efficiently. Also, since the gaps is nonexistent or very small, a dark region caused by the gaps is reduced and a uniform light distribution is obtained in the light distribution pattern formed on a road surface in front of a driver's own vehicle.

Figure 3A:
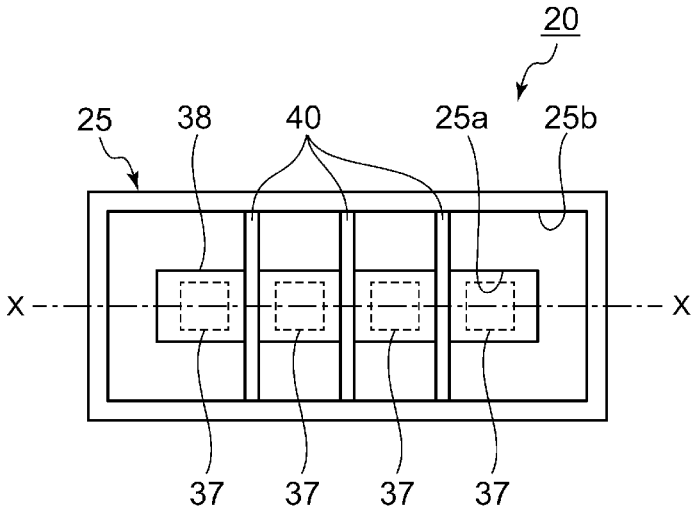
FIG. 3A and FIG. 3B are diagrams for explaining a structure of a light emitting apparatus according to a second embodiment.
Figure 3B:
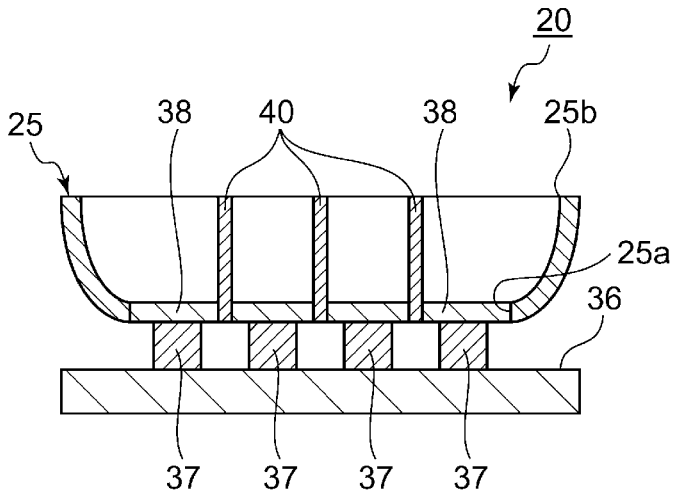

FIG. 3A and FIG. 3B are diagrams for explaining a structure of a light emitting apparatus according to a second embodiment. FIG. 3A is a front view of a light emitting apparatus. FIG. 3B is a cross-sectional view (horizontal cross-sectional view) taken along the line X-X of FIG. 3A. A light emitting apparatus 20 according to the second embodiment is applicable to the automotive lamp 100 as well.

In the light emitting apparatus 20 according to the second embodiment, the same or corresponding components as or to those of the light emitting apparatus according to the first embodiment shown in FIG. 2A to FIG. 2C are denoted with the same reference numerals as those thereof, and the repeated description thereof will be omitted as appropriate.

The light emitting apparatus 20 according to the second embodiment differs from the above-described light emitting apparatus according to the first embodiment in that the light condenser 25 has three light shielding parts 40. The three light shielding parts 40 are plate-like or membrane-like members, which extend from the first opening 25*a* to the second opening 25*b* within the light condenser 25, in such a manner as to demarcate the phosphor layer 38 corresponding to the emission surface of a pair of adjacent LED chips 37. The light shielding part 40 is not limited to any particular one as long as it absorbs, reflects, diffuses and blocks the light. The light shielding part 40 as used herein may be a colored resin board, a resin board containing light reflective material, a light-blocking inorganic material, a metal, a multi-layer film where films having different refractive indices are laminated, and so forth, for instance.

In the case where no shielding parts is provided as in the first embodiment, there are cases where a desired light distribution pattern cannot be appropriately formed by controlling the turning on and off of each LED chip 37 when the light emitted from each LED chip 37 is diffused inside the light condenser 25. In the case where the light shielding parts 40 are provided in the light condenser 25 as in the second embodiment, on the other hand, the range where the light emitted from each LED chip 37 diffuses is limited, so that a desired light distribution pattern can be appropriately formed.

Figure 4A:
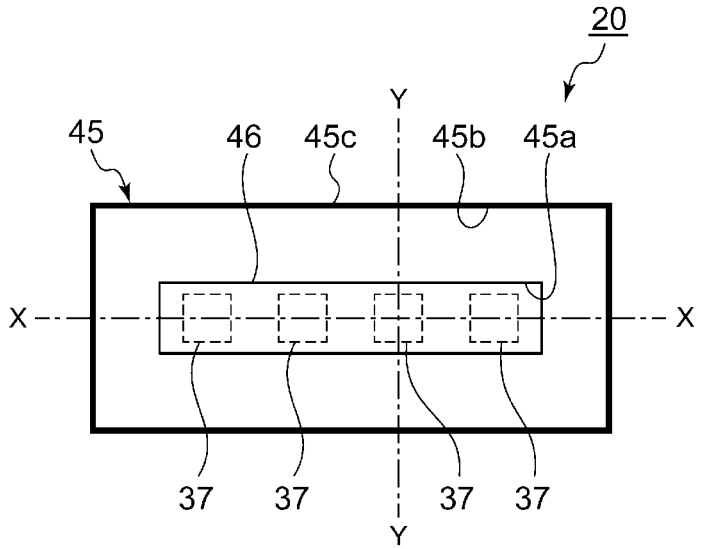
FIG. 4A to FIG. 4C are diagrams for explaining a structure of a light emitting apparatus according to a third embodiment.
Figure 4B:
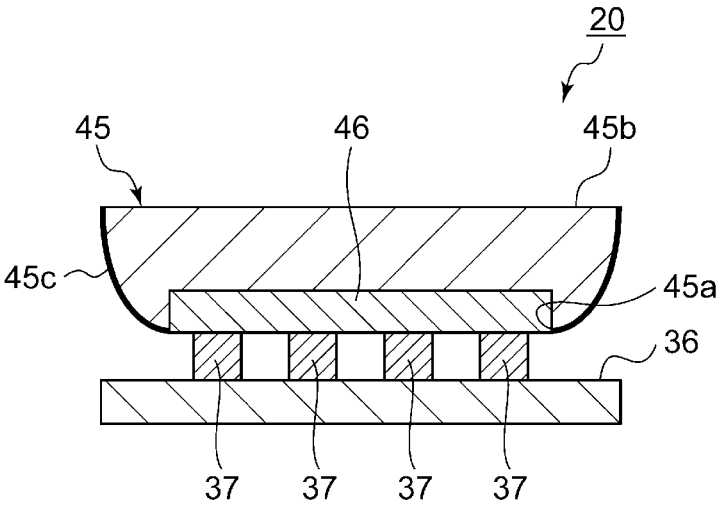
Figure 4C:
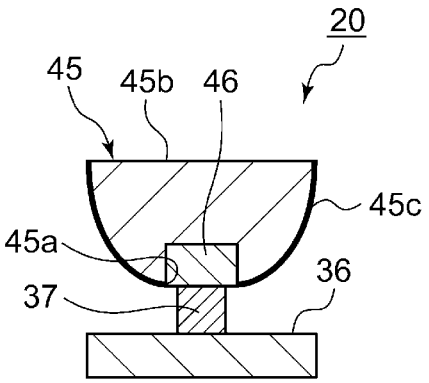

FIG. 4A to FIG. 4C are diagrams for explaining a structure of a light emitting apparatus according to a third embodiment. FIG. 4A is a front view of the light emitting apparatus. FIG. 4B is a cross-sectional view (horizontal cross-sectional view) taken along the line X-X of FIG. 4A. FIG. 4C is a cross-sectional view (vertical cross-sectional view) taken along the line Y-Y of FIG. 4A. A light emitting apparatus 20 according to the third embodiment is applicable to the automotive lamp 100 as well.

In the light emitting apparatus 20 according to the third embodiment, the same or corresponding components as or to those of the light emitting apparatus according to the first embodiment shown in FIG. 2A to FIG. 2C are denoted with the same reference numerals as those thereof, and the repeated description thereof will be omitted as appropriate.

The light emitting apparatus 20 according to the third embodiment differs in the structure of the light condenser, placed on the LED chips 37, from the above-described light emitting apparatus according to the first embodiment. The light condenser 45 according to the third embodiment is constituted by a molded body (compact) made of transparent material. The transparent material as used herein may be an inorganic material, an organic thermoplastic resin, or a thermosetting resin, as long as it transmits light. Such a transparent inorganic material as used herein may preferably be molten silica or fused quartz, calcium aluminate glass, lithium niobate, chalcide, titanium oxide, strontium titanate, alumina, lithium fluoride, yttrium oxide, magnesium oxide, zirconia, magnesium fluoride, calcium fluoride, sodium fluoride, barium fluoride, lead fluoride, sodium iodide, sodium chloride, potassium chloride, silver chloride, thallium chloride, thallium chloride-bromide, potassium bromide, silver bromide, thallium bromide, potassium iodide, cesium bromide, cesium iodide, quartz glass or soda-lime glass, oxide glass (e.g., optical glass), fluoride glass, chalcogen glass, or the like, for instance. Such a transparent thermoplastic resin as used herein may be polystyrene, acrylonitrile-styrene copolymer resin, transparent acrylonitrile-butadiene-styrene (ABS) resin, styrene-butadiene copolymer, styrene-maleic anhydride based resin, methacrylic resin, cellulose acetate, polyester carbonate, polymethylpentene, polyarylate, polyethersulfone, polyether ether ketone, polycarbonate, transparent nylon, polysulfone resin, polyolefin, polyvinyl butyral, or the like, for instance. Among those transparent thermoplastic resins listed above, preferable in terms of heat resistance are methacrylic resin, polyester carbonate, polymethylpentene, polyarylate, polyethersulfone, polyether ether ketone, polycarbonate, transparent nylon, polysulfone resin. Such a transparent thermosetting resin as used herein may be silicone resin, epoxy resin, phenol resin, phenol aralkyl resin, unsaturated polyester resin, polyimide resin, silica-based sol-gel agent, alumina-based sol-gel agent, titania-based sol-gel agent, zirconia-based sol-gel agent, or the like, for instance. Among those transparent thermosetting resins listed above, silicone resin and epoxy resin are preferable in terms of transparency.

The light condenser 45 is formed in an approximately rectangular parallelepiped shape and has a first surface part 45*a*, a second surface part 45*b* disposed counter to the first surface part 45*a*, and a side surface part 45*c* disposed in between the first surface part 45*a* and the second surface part 45*b*.

The first surface part 45*a* and the second surface part 45*b* are each formed in a rectangular shape. The second surface part 45*b* is larger in size than the first surface part 45*a*. In the light condenser 45, the first surface part 45*a* functions as an incident part through which the light emitted from the LED chips 37 enters, and the second surface part 45*b* functions as an emission part that emits the light.

The side surface part 45*c* has four outer surfaces provided for each side of the first surface part 45*a* and the second surface part 45*b* of rectangle shapes. Here, the four outer surfaces are parabolic in cross section. A metallic film is formed on each of the outer surfaces of the side surface part 45*c*, and the side surface part 45*c* functions as a reflector that reflects the light entering from the first surface part 45*a*.

In the third embodiment, a plate-shaped phosphor 46 is partially embedded in the first surface part 45*a* of the light condenser 45. More specifically, the phosphor 46 is embedded in the first surface part 45*a* of the light condenser 45 in a manner such that one of the rectangular surfaces of the phosphor 46, which serves as a light incident surface, is exposed to outside. The phosphor 46 is one obtained when a yellow phosphor, which converts blue light into yellow light, is turned into ceramics and then formed in a rectangular-plate shape. The phosphor 46 may be a sintered plate formed of yttrium aluminum garnet (YAG). The light condenser 45 where the phosphor 46 is embedded is arranged such that the phosphor 46 is located on the light emission surfaces of the four LED chips 37. An exposed surface (light incident surface) of the phosphor 46 is in contact with the light emission surfaces of the LED chips 37. Also, the phosphor 46 is optically coupled via a not-shown transparent material.

Illuminating the LED chips 37 in the light emitting apparatus 20 configured as above allows the blue light, which has transmitted through the phosphor 46, and the yellow light, whose wavelength has been converted from the blue light by the phosphor 46, to be mixed together. As a result, white light is obtained.

As described above, in the light emitting apparatus 20 according to the third embodiment, the plate-shaped phosphor 46 is embedded in the first surface part 45*a*, which is the incident part of the light condenser 45. And the light condenser 45 is arranged such that the light incident surface of the phosphor 46 covers the light emission surfaces of the four LED chips 37. Such a structure as this allows most of light emitted from the LED chips 37 and the phosphor 46 to enter the light condenser 45. As a result, the projection lens 30 can direct more light and therefore the utilization efficiency of light emitted therefrom can be improved in the automotive lamp 100.

Figure 5A:
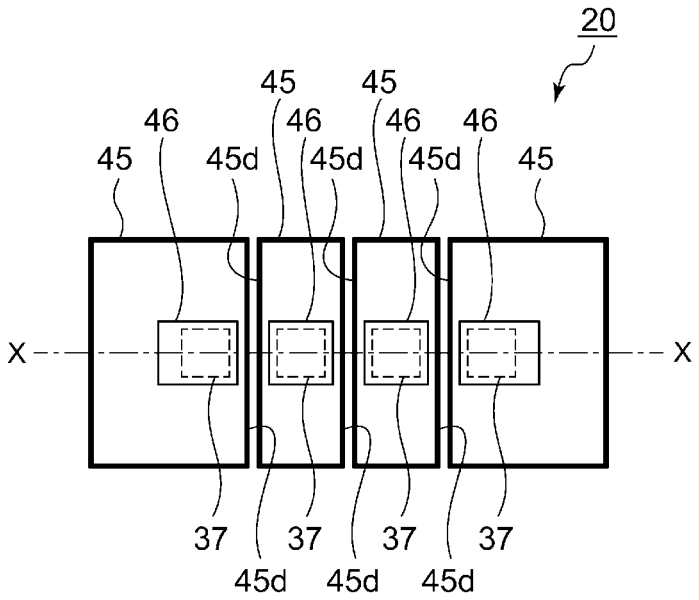
FIG. 5A and FIG. 5B are diagrams for explaining a structure of a light emitting apparatus according to a fourth embodiment.
Figure 5B:
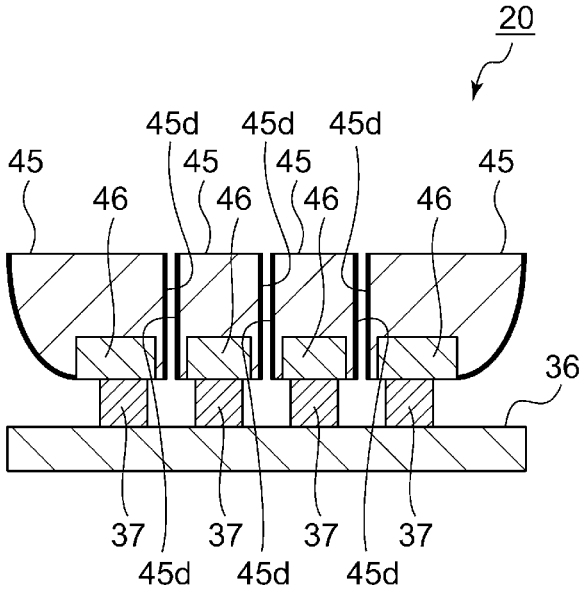

FIG. 5A and FIG. 5B are diagrams for explaining a structure of a light emitting apparatus according to a fourth embodiment. FIG. 5A is a front view of a light emitting apparatus. FIG. 5B is a cross-sectional view (horizontal cross-sectional view) taken along the line X-X of FIG. 5A. A light emitting apparatus 20 according to the fourth embodiment is applicable to the automotive lamp 100 as well.

In the light emitting apparatus 20 according to the fourth embodiment, the same or corresponding components as or to those of the light emitting apparatus according to the third embodiment shown in FIG. 4A to FIG. 4C are denoted with the same reference numerals as those thereof, and the repeated description thereof will be omitted as appropriate.

The light emitting apparatus 20 according to the fourth embodiment is configured such that the light condenser in the third embodiment is divided into four portions and such that each portion of the thus divided light condensers 45 is provided on top of the LED chips 37 corresponding respectively to the divided light condensers 45. A phosphor 46 is embedded in each light condenser 45.

In the molded body, which is made of transparent material (hereinafter referred to as "transparent molded body" also), of each light condenser 45 according to the fourth embodiment, a metallic film is formed on an adjacent surface 45*d* facing an adjacent transparent molded body as well as the outer surface of the side surface part. As a result, similar to the light emitting apparatus according to the above-described second embodiment, the range where the light emitted from each LED chip 37 diffuses is limited, so that a desired light distribution pattern can be appropriately formed.

Figure 6A:
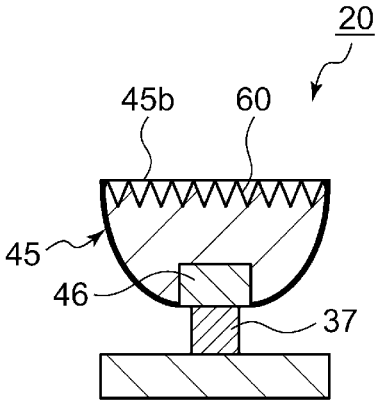
FIG. 6A to FIG. 6C are diagrams for explaining modifications of the light emitting apparatus according to the third embodiment.
Figure 6B:
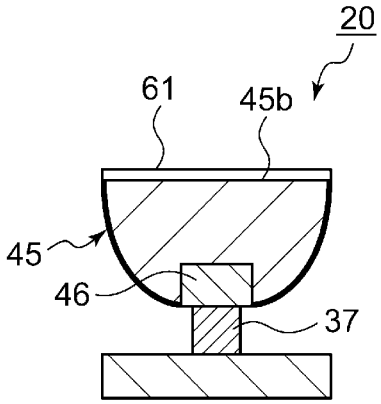
Figure 6C:
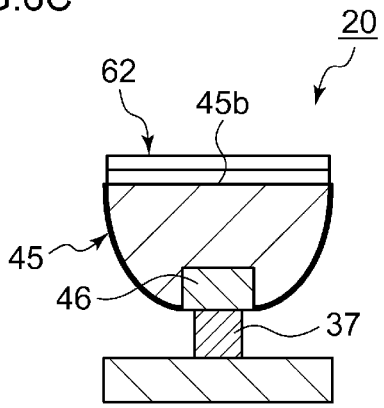

FIG. 6A to FIG. 6C are diagrams for explaining modifications of the light emitting apparatus according to the third embodiment.

FIG. 6A shows a first modification where asperities 60 are formed on the second surface part 45*b* (light emission surface) of the light condenser 45. The asperities 60 may be formed by spraying sand particles onto the light emission surface of the light condenser 45 using a sandblasting method. Or alternatively, the asperities 60 may be formed, at the time of the formation of the transparent molded body, by transcribing a fine asperity structure into the incident part using a mold having fine asperities. Forming such asperities 60 as described above onto the light emission surface of the light condenser 45 can enhance the extraction efficiency of light by reducing the total reflection.

FIG. 6B shows a second modification where a thin film 61 made of a low refractive index material is formed on top of the second surface part 45*b* (light emission surface) of the light condenser 45. The refractive index of the thin film 61 is lower than that of the transparent molded body constituting the light condenser 45. If, for example, the transparent molded body is formed of dimethyl silicone (the refractive index: 1.41), a silica-based sol-gel material (the refractive index: 1.35) may be used as the low refractive index material. The formation of such a thin film 61 as aforementioned on the light emission surface of the light condenser 45 can improve the utilization efficiency of light as well.

FIG. 6C shows a third modification where a thin film 62, which is structured such that a low refractive index material and a high refractive index material are alternately stacked therein, is formed on the second surface part 45*b* (light emission surface) of the light condenser 45. If, for example, the transparent molded body is formed of dimethyl silicone (the refractive index: 1.41), silica may be used as the low refractive index material and titanium oxide may be used as the high refractive index material. The formation of such a thin film 62 as aforementioned on the light emission surface of the light condenser 45 can improve the utilization efficiency of light as well.

Figure 7:
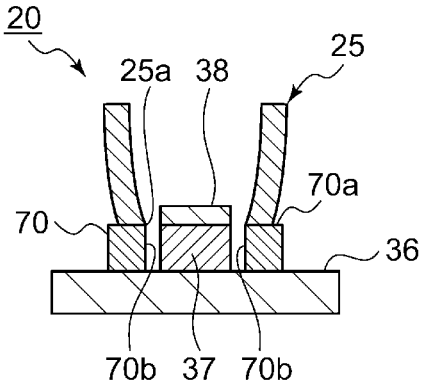
FIG. 7 is a diagram for explaining a structure of a light emitting apparatus according to a fifth embodiment.

FIG. 7 is a diagram for explaining a structure of a light emitting apparatus according to a fifth embodiment. FIG. 7 is a vertical cross-sectional view of a light emitting apparatus 20. The light emitting apparatus 20 according to the fifth embodiment is applicable to the automotive lamp 100 as well.

In the light emitting apparatus 20 according to the fifth embodiment, the same or corresponding components as or to those of the light emitting apparatus according to the first embodiment shown in FIG. 2A to FIG. 2C are denoted with the same reference numerals as those thereof, and the repeated description thereof will be omitted as appropriate.

In the light emitting apparatus 20 shown in FIG. 7, a reflector frame body 70 is provided on the LED substrate 36. The reflector frame body 70 is provided on the LED substrate 36 in such a manner as to surround the side surfaces of the LED chips 37. The phosphor layer 38 is provided on the light emission surfaces of the LED chips 37.

The light condenser 25 is provided on a top face 70*a* of the reflector frame body 70. In the state where the light condenser 25 is being provided on a top face 70*a* of the reflector frame body 70, the phosphor layer 38 is located within the first opening 25*a* (the incident part of the light condenser 25) of the light condenser 25. The light condenser 25 and the reflector frame body 70 may be formed integrally with each other. Or alternatively, the light condenser 25 and the reflector frame body 70 may be formed separately and mounted using an adhesive or the like.

The reflector frame body 70 has light-reflecting surfaces 70*b* that face the side surfaces of the LED chips 37. Provision of the reflector frame body 70 in such a manner as to surround the LED chips 37 allows the light emitted from the side surfaces of the LED chips 37 to be reflected toward the light condenser 25. As a result, the utilization efficiency of light emitted from the LED chips 37 can be improved. The reflector frame body 70 may be formed of a metal or may be formed by reflection-coating the inner surface of the frame body that is molded with a resin material.

The present invention has been described based upon illustrative embodiments. These embodiments are intended to be illustrative only and it will be obvious to those skilled in the art that various modifications to constituting elements and processes could be developed and that such modifications are also within the scope of the present invention.

Although, in the above-described embodiments, the LEDs are used as the light source, other light sources such as laser beams may naturally be used instead.

Although, in the above-described embodiments, white light is produced using the blue-color LED and the phosphor of YAG, the white light may be produced using a near-ultraviolet light emitting LED and a phosphor that emits visible light by absorbing the near-ultraviolet light.

What is claimed is:

1. A light emitting apparatus comprising:

a mounting part that mounts a light emitting device thereon; and a light condenser that condenses light emitted from the light emitting device, the light condenser including:

an incident part through which the light emitted from the light emitting device enters;

a reflector that reflects light entering from the incident part; and an emission part that emits light reflected by the reflector, wherein a phosphor layer, which converts a wavelength of the light emitted from the light emitting device and emits the wavelength-converted light, is formed in the incident part, wherein the light condenser is arranged such that the phosphor layer is located on a light emission surface of the light emitting device, wherein the light condenser includes a molded body made of transparent material having a first surface part, a second surface part disposed counter to the first surface part, and a side surface part disposed in between the first surface part and the second surface part, wherein the first surface part functions as the incident part, the second surface part functions as the emission part, and the reflector is formed such that a metallic film is formed on an outer surface of the side surface part, wherein the phosphor layer is formed by embedding a part of plate-shaped phosphor in the first surface part, wherein the mounting part is arranged such that a plurality of light emitting devices are able to be mounted side by side, wherein the molded body made of transparent material is arranged for each of the plurality of light emitting devices, wherein, in each molded body made of transparent material, an adjacent surface facing the adjacent molded body made of transparent material is formed into flat surface, and wherein, in each molded body made of transparent material, a metallic film is formed on the adjacent surface facing the adjacent molded body made of transparent material as well as the outer surface of the side surface part.

2. An automotive lamp comprising:

a light emitting apparatus according to any one of claim 1; and an optical member that controls the light emitted from the light emitting apparatus so as to emit the light therefrom toward a front area of the automotive lamp.

* * * * *